US007673667B2

(12) United States Patent
Domel et al.

(10) Patent No.: US 7,673,667 B2
(45) Date of Patent: Mar. 9, 2010

(54) LOW POWER, HIGH RESOLUTION POSITION ENCODER FOR MOTORIZED WINDOW COVERING

(75) Inventors: Douglas R. Domel, Santa Clarita, CA (US); Winston G. Walker, Littleton, CO (US)

(73) Assignee: Harmonic Design, Inc., Poway, CA (US)

( * ) Notice: Subject to any disclaimer, the term of this patent is extended or adjusted under 35 U.S.C. 154(b) by 0 days.

(21) Appl. No.: 10/272,640

(22) Filed: Oct. 16, 2002

(65) Prior Publication Data

US 2003/0145958 A1 Aug. 7, 2003

Related U.S. Application Data

(63) Continuation-in-part of application No. 10/062,655, filed on Feb. 1, 2002.

(51) Int. Cl.
*E06B 9/32* (2006.01)

(52) U.S. Cl. ..... 160/168.1 P; 160/176.1 P

(58) Field of Classification Search ..... 160/168.1 P, 160/176.1 P, 188, 310, 1
See application file for complete search history.

(56) References Cited

U.S. PATENT DOCUMENTS

| | | | | |
|---|---|---|---|---|
| 4,856,574 | A * | 8/1989 | Minami et al. | 160/168.1 R |
| 5,038,087 | A * | 8/1991 | Archer et al. | 318/469 |
| 5,081,402 | A | 1/1992 | Koleda | 318/16 |
| 5,274,499 | A | 12/1993 | Shopp | 359/461 |
| 5,467,808 | A * | 11/1995 | Bell | 160/168.1 P |
| 5,729,101 | A * | 3/1998 | Richmond et al. | 318/282 |
| 5,793,174 | A | 8/1998 | Kovach et al. | 318/463 |
| 5,848,634 | A | 12/1998 | Will et al. | 160/310 |
| 5,929,580 | A * | 7/1999 | Mullet et al. | 318/466 |
| 6,433,498 | B1 | 8/2002 | Domel et al. | 318/280 |
| 6,497,267 | B1 * | 12/2002 | Azar et al. | 160/310 |

FOREIGN PATENT DOCUMENTS

| | | | |
|---|---|---|---|
| JP | 58-29028 | 2/1983 | 1/66 |
| JP | 60-109484 | 6/1985 | 9/32 |
| JP | 1-192987 | 8/1989 | 9/32 |
| JP | 4-363495 | 12/1992 | 9/264 |

* cited by examiner

*Primary Examiner*—Blair M. Johnson
(74) *Attorney, Agent, or Firm*—Procopio Cory Hargreaves & Savitch LLP; Noel C. Gillespie

(57) ABSTRACT

A motorized window covering has a motor and a housing that holds the motor and a dc battery. When the motor is energized to move a window covering, a pulse detector counts the motor current pulses to determine the position of the window covering. A user can save a motor current pulse count corresponding to a desired position and then return the desired position from a different position by simply pressing a button on a remote control unit. Further, inaccuracies caused by motor current pulses that were not counted by the pulse detector, e.g., at start up, at shut down, or during coast down, are minimized by error correction logic.

14 Claims, 5 Drawing Sheets

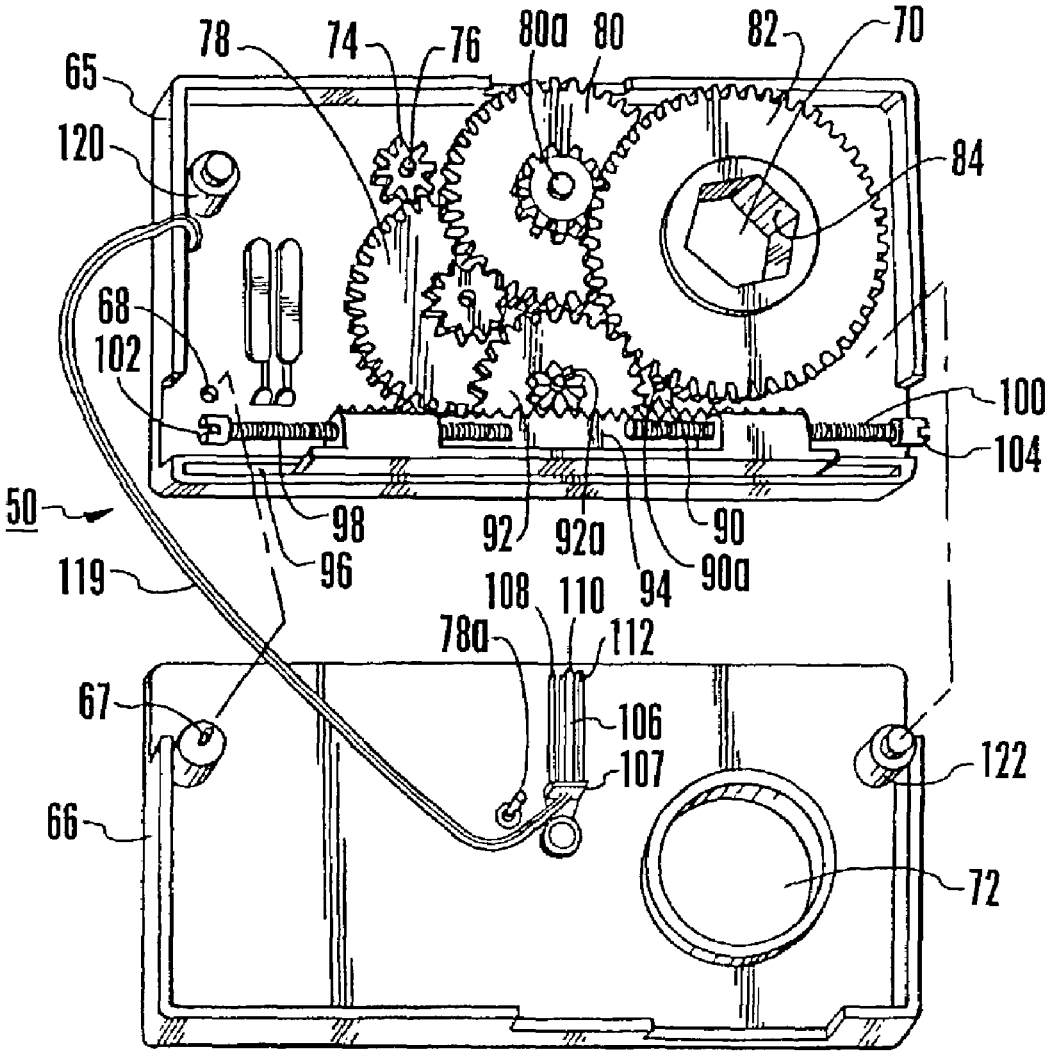
Fig. 2
Fig. 3A
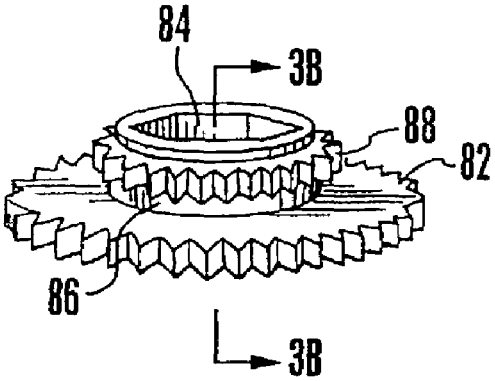
Fig. 3B
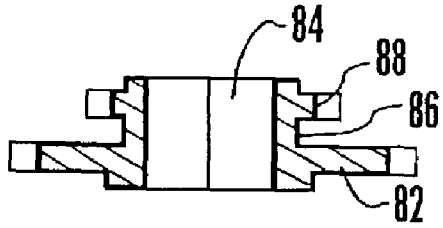

LOW POWER, HIGH RESOLUTION POSITION ENCODER FOR MOTORIZED WINDOW COVERING

1. RELATED APPLICATIONS

The present invention is a Continuation-in-Part of the U.S. patent application Ser. No. 10/062,655 filed on Feb. 1, 2002.

2. FIELD OF THE INVENTION

The present invention relates generally to window covering peripherals and more particularly to remotely-controlled window covering actuators.

3. BACKGROUND OF THE INVENTION

Window coverings that can be opened and closed are used in a vast number of business buildings and dwellings. Examples of such coverings include horizontal blinds, vertical blinds, pleated shades, roll-up shades, and cellular shades made by, e.g., Spring Industries®, Hunter-Douglas®, and Levellor®.

The present assignee has provided several systems for either lowering or raising a window covering, or for moving the slats of a window covering between open and closed positions. Such systems are disclosed in U.S. Pat. Nos. 6,189,592, 5,495,153, and 5,907,227, incorporated herein by reference. These systems include a motor driven gear box that is coupled to a tilt rod of the window covering. When the motor is energized, the tilt rod rotates clockwise or counterclockwise. These systems can be operated, e.g., with a remote control unit. Using the remote control unit, a user can hold an "Open" button or "Close" button continuously until a desired position of the window covering is reached. Alternatively, the user can depress a single button corresponding to a position of the window covering and the window covering will automatically move to that position, e.g., fully open, half open, close, etc.

Automated systems for opening and closing the window covering to a predetermined location typically require an encoder to be placed somewhere in the gear train. For example, the encoder can be a magnet placed on the output gear with a Hall effect sensor placed just outside the outer periphery of the output gear. As the output gear rotates, the Hall effect sensor senses the magnet and the position of the window covering can be determined. Unfortunately, this type of encoder can have relatively low resolution and as such, the accuracy of any determination of the position of the window covering can be limited.

Accordingly, it is an object of the present invention to provide an remotely controlled and automatic window covering control system having a relatively high resolution position encoder.

SUMMARY OF THE INVENTION

A method for controlling a motorized window covering includes providing a counter. A user-defined position of the window covering is established. In response to a user generated signal, a motor coupled to the window covering is energized. As the motor rotates, the current in the motor varies periodically, and the motor current pulses are counted by the counter. Based on the motor current pulse count, it can be determined when the window covering reaches the user-defined position. If, for any reason, there is a drift in the position of the shade, the window covering may be moved to a hard stop and the position counter reset to zero.

In a preferred embodiment, when the window covering reaches the user-defined position, the motor is de-energizing. Preferably, the user generated signal is generated by a remote control unit. Moreover, in a preferred embodiment, the user-defined position is established by energizing the motor to move the window covering. While the motor rotates, the motor current pulses are counted. The motor is de-energized to stop the window covering and a motor current pulse count corresponding to the position of the window covering is saved.

Preferably, the method further includes determining an "Error Correction" value. The motor current pulse count is altered based on the "Error Correction" value. In a preferred embodiment, the "Error Correction" value is determined by determining a "Net Spikes" value and a "Non-hard Stop Movements" value. The "Net Spikes" value is divided by the "Non-hard Stop Movements" value.

In another aspect of the present invention, a motorized window covering includes a window covering. An actuator is coupled to the window covering and is used to move the window covering. A motor is coupled to the actuator and a motor current pulse detector is electrically connected to the motor. The motor current pulse detector counts motor current pulses when the motor is energized and periodically, the motor current pulse detector is reset to zero.

The details of the present invention, both as to its construction and operation, can best be understood in reference to the accompanying drawings, in which like numerals refer to like parts, and which:

BRIEF DESCRIPTION OF THE DRAWINGS

FIG. 2 is a perspective view of the gear assembly of the actuator of the present invention, with portions broken away;

FIG. 3A is a perspective view of the main reduction gear of the actuator of the present invention;

FIG. 3B is a cross-sectional view of the main reduction gear of the actuator of the present invention, as seen along the line 3B-3B in FIG. 3A;

DETAILED DESCRIPTION OF THE PREFERRED EMBODIMENT

Figure 1:
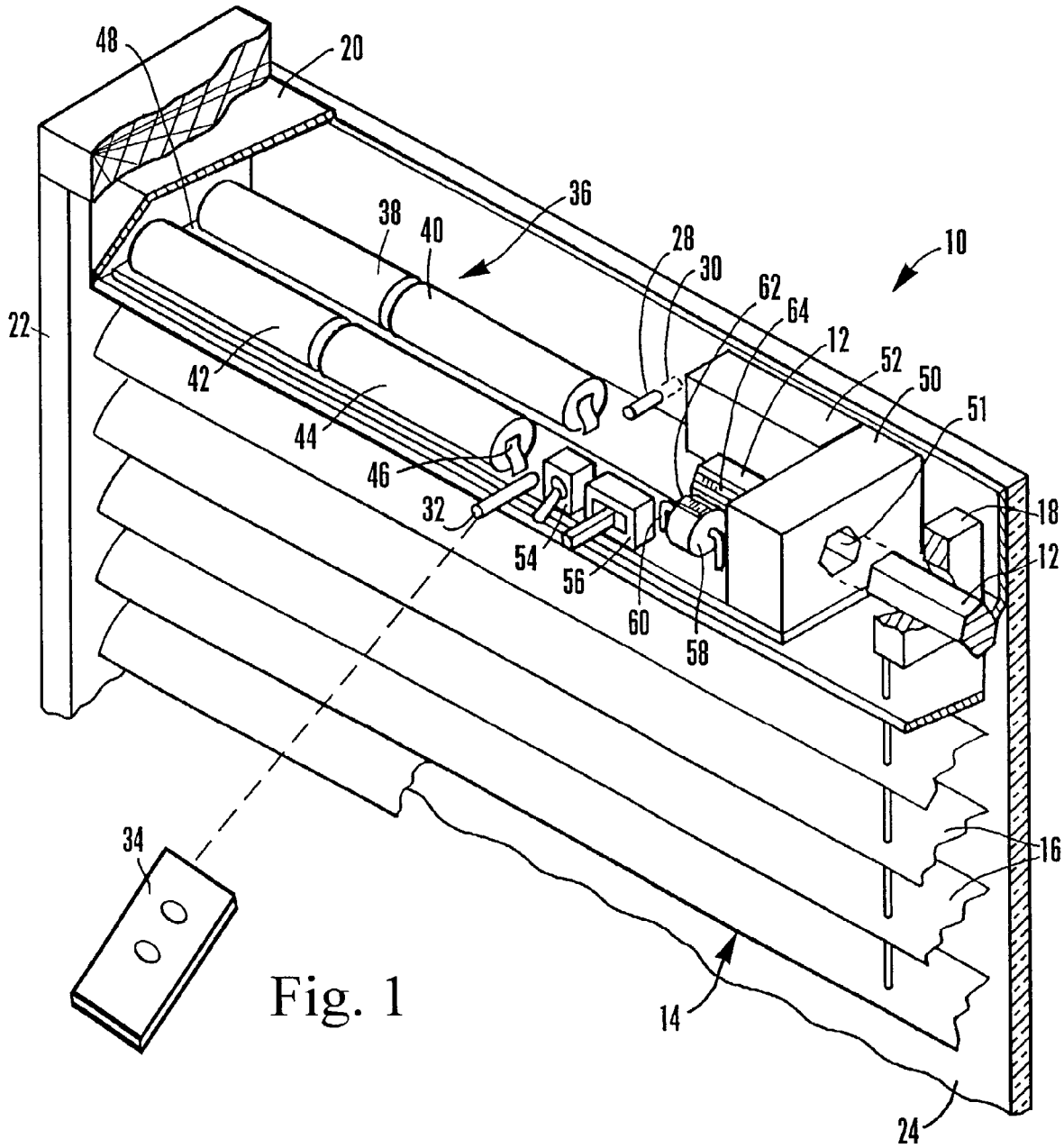
FIG. 1 is a perspective view of a window covering actuator of the present invention, shown in one intended environment, with portions of the head rail cut away for clarity.

Referring initially to FIG. 1, an actuator is shown, generally designated 10. As shown, the actuator 10 is in operable engagement with a rotatable tilt rod 12 of a window covering, such as but not limited to a horizontal blind 14 having a plurality of louvered slats 16. As shown, the tilt rod 12 is rotatably mounted by means of a block 18 in a head rail 20 of the blind 14.

In the embodiment shown, the blind 14 is mounted on a window frame 22 to cover a window 24, and the tilt rod 12 is rotatable about its longitudinal axis. The tilt rod 12 engages a baton (not shown), and when the tilt rod 12 is rotated about its longitudinal axis, the baton (not shown) rotates about its longitudinal axis and each of the slats 16 is caused to rotate about its respective longitudinal axis to move the blind 14 between an open configuration, wherein a light passageway is established between each pair of adjacent slats, and a closed configuration, wherein no light passageways are established between adjacent slats.

While the embodiment described above discusses a blind, it is to be understood that the principles of the present invention apply to a wide range of window coverings including, but not limited to the following: vertical blinds, fold-up pleated shades, roll-up shades, cellular shades, skylight covers, and any type of blinds that utilize vertical or horizontal louvered slats.

A control signal generator, preferably a daylight sensor 28, is mounted within the actuator 10 by means well-known in the art, e.g., solvent bonding. In accordance with the present invention, the daylight sensor 28 is in light communication with a light hole 30 through the back of the head rail 20, shown in phantom in FIG. 1. Also, the sensor 28 is electrically connected to electronic components within the actuator 10 to send a control signal to the components, as more fully disclosed below. Consequently, with the arrangement shown, the daylight sensor 28 can detect light that propagates through the window 24, independent of whether the blind 14 is in the open configuration or the closed configuration.

Further, the actuator 10 can include another control signal generator, preferably a signal sensor 32, for receiving a preferably optical user command signal. Preferably, the user command signal is generated by a hand-held user command signal generator 34, which can be an infrared (IR) remote-control unit. In one presently preferred embodiment, the generator 34 generates a pulsed signal.

Like the daylight sensor 28, the signal sensor 32 is electrically connected to electronic components within the actuator 10. As discussed in greater detail below, either one of the daylight sensor 28 and signal sensor 32 can generate an electrical control signal to activate the actuator 10 and thereby cause the blind 14 to move toward the open or closed configuration, as appropriate.

Preferably, both the daylight sensor 28 and signal sensor 32 are light detectors which have low dark currents, to conserve power when the actuator 10 is deactivated. More particularly, the sensors 28, 32 have dark currents equal to or less than about $10^{-8}$ amperes and preferably equal to or less than about $2\times10^{-9}$ amperes.

As shown in FIG. 1, a power supply 36 is mounted within the head rail 20. In the preferred embodiment, the power supply 36 includes four or six or other number of type AA direct current (dc) alkaline or Lithium batteries 38, 40, 42, 44. Or, the batteries can be nine volt "transistor" batteries. The batteries 38, 40, 42, 44 are mounted in the head rail 20 in electrical series with each other by means well-known in the art. For example, in the embodiment shown, two pairs of the batteries 38, 40, 42, 44 are positioned between respective positive and negative metal clips 46 to hold the batteries 38, 40, 42, 44 within the head rail 20 and to establish an electrical path between the batteries 38, 40, 42, 44 and their respective clips.

FIG. 1 further shows that an electronic circuit board 48 is positioned in the head rail 20 beneath the batteries 38, 40, 42, 44. It can be appreciated that the circuit board 48 can be fastened to the head rail 20, e.g., by screws (not shown) or other well-known method and the batteries can be mounted on the circuit board 48. It is to be understood that an electrical path is established between the battery clips 46 and the electronic circuit board 48. Consequently, the batteries 38, 40, 42, 44 are electrically connected to the electronic circuit board 48. Further, it is to be appreciated that the electronic circuit board 48 may include a microprocessor.

Still referring to FIG. 1, a lightweight metal or molded plastic gear box 50 is mounted preferably on the circuit board 48. The gear box 50 can be formed with a channel 51 sized and shaped for receiving the tilt rod 12 therein. As can be appreciated in reference to FIG. 1, the tilt rod 12 has a hexagonally-shaped transverse cross-section, and the tilt rod 12 is slidably engageable with the gear box opening 51. Accordingly, the actuator 10 can be slidably engaged with the tilt rod 12 substantially anywhere along the length of the tilt rod 12.

FIG. 1 also shows that a small, lightweight electric motor 52 is attached to the gear box 50, preferably by bolting the motor 52 to the gear box 50. As more fully disclosed in reference to FIG. 2 below, the gear box 50 holds a gear assembly which causes the tilt rod 12 to rotate at a fraction of the angular velocity of the motor 52. Preferably, the motor 52 can be energized by the power supply 36 through the electronic circuitry of the circuit board 48 and can be mounted on the circuit board 48.

Also, in a non-limiting embodiment, a manually manipulable operating switch 54 can be electrically connected to the circuit board 48. The switch 54 shown in FIG. 1 is a two-position on/off power switch used to turn the power supply on and off. Further, a three-position mode switch 56 is electrically connected to the circuit board 48. The switch 56 has an "off" position, wherein the daylight sensor 28 is not enabled, a "day open" position, wherein the blind 14 will be opened by the actuator 10 in response to daylight impinging on the sensor 28, and a "day shut" position, wherein the blind 14 will be shut by the actuator 10 in response to daylight impinging on the sensor 28.

FIG. 1 further shows that in another non-limiting embodiment, a manually manipulable adjuster 58 can be rotatably mounted on the circuit board 48 by means of a bracket 60. The periphery of the adjuster 58 extends beyond the head rail 20, so that a person can turn the adjuster 58.

As intended by the present invention, the adjuster 58 can have a metal strip 62 attached thereto, and the strip 62 on the adjuster 58 can contact a metal tongue 64 which is mounted on the tilt rod 12 when the tilt rod 12 has rotated in the open direction.

When the strip 62 contacts the tongue 64, electrical contact is made therebetween to signal an electrical circuit on the circuit board 48 to de-energize the motor 52. Accordingly, the adjuster 58 can be rotationally positioned as appropriate such that the strip 62 contacts the tongue 64 at a predetermined angular position of the tilt rod 12. Stated differently, the tilt rod 12 has a closed position, wherein the blind 14 is fully closed, and an open position, wherein the blind 14 is open, and the open position is selectively established by manipulating the adjuster 58.

Now referring to FIGS. 2, 3A, and 3B, the details of the gear box 50 can be seen. As shown best in FIG. 2, the gear box 50 includes a plurality of lightweight metal or molded plastic gears, i.e., a gear assembly, and each gear can be rotatably mounted within the gear box 50. In the presently preferred embodiment, the gear box 50 is a clamshell structure which includes a first half 65 and a second half 66, and the halves 65, 66 of the gear box 50 are snappingly engageable together by means well-known in the art. For example, in the embodiment shown, a post 67 in the second half 66 of the gear box 50 engages a hole 68 in the first half 65 of the gear box 50 in an interference fit to hold the halves 65, 66 together.

Each half 62, 64 includes a respective opening 70, 72, and the openings 70, 72 of the gear box 50 are coaxial with the gear box channel 51 (FIG. 1) for slidably receiving the tilt rod 12 therethrough.

As shown in FIG. 2, a motor gear 74 is connected to the rotor 76 of the motor 60. In turn, the motor gear 74 is engaged with a first reduction gear 78, and the first reduction gear 78 is engaged with a second reduction gear 80. In turn, the second reduction gear 80 is engaged with a main reduction gear 82. To closely receive the hexagonally-shaped tilt rod 12, the main reduction gear 82 has a hexagonally-shaped channel 84. As intended by the present invention, the channel 84 of the main reduction gear 82 is coaxial with the openings 70, 72 (and, thus, with the gear box channel 51 shown in FIG. 1).

It can be appreciated in reference to FIG. 2 that when the main reduction gear 82 is rotated, and the tilt rod 12 is engaged with the channel 84 of the main reduction gear 82, the sides of the channel 84 contact the tilt rod 12 to prevent rotational relative motion between the tilt rod 12 and the main reduction gear 82. Further, the reduction gears 78, 80, 82 cause the tilt rod 12 to rotate at a fraction of the angular velocity of the motor 60. Preferably, the reduction gears 78, 80, 82 reduce the angular velocity of the motor 60 such that the tilt rod 12 rotates at about one revolution per second. It can be appreciated that greater or fewer gears than shown can be used.

It is to be understood that the channel 84 of the main reduction gear 82 can have other shapes suitable for conforming to the shape of the particular tilt rod being used. For example, for a tilt rod (not shown) having a circular transverse cross-sectional shapes, the channel 84 will have a circular cross-section. In such an embodiment, a set screw (not shown) is threadably engaged with the main reduction gear 82 for extending into the channel 84 to abut the tilt rod and hold the tilt rod stationary within the channel 84. In other words, the gears 74, 78, 80, 82 described above establish a coupling which operably engages the motor 60 with the tilt rod 12.

In continued cross-reference to FIGS. 2, 3A, and 3B, the main reduction gear 82 is formed on a hollow shaft 86, and the shaft 86 is closely received within the opening 70 of the first half 62 of the gear box 50 for rotatable motion therein. Also, in a non-limiting embodiment, a first travel limit reduction gear 88 is formed on the shaft 86 of the main reduction gear 82. The first travel limit reduction gear 88 is engaged with a second travel limit reduction gear 90, and the second travel limit reduction gear 90 is in turn engaged with a third travel limit reduction gear 92.

FIG. 2 best shows that the third travel limit reduction gear 92 is engaged with a linear rack gear 94. Thus, the main reduction gear 82 is coupled to the rack gear 94 through the travel limit reduction gears 88, 90, 92, and the rotational speed (i.e., angular velocity) of the main reduction gear 82 is reduced through the first, second, and third travel limit reduction gears 88, 90, 92. Also, the rotational motion of the main reduction gear 82 is translated into linear motion by the operation of the third travel limit reduction gear 92 and rack gear 94.

FIG. 2 also shows that in non-limiting embodiments the second reduction gear 80 and second and third travel limit reduction gears 90, 92 can be rotatably engaged with respective metal post axles 80*a*, 90*a*, 92*a* which are anchored in the first half 65 of the gear box 50. In contrast, the first reduction gear 78 is rotatably engaged with a metal post axle 78*a* which is anchored in the second half 66 of the gear box 50.

Still referring to FIG. 2, the rack gear 94 is slidably engaged with a groove 96 that is formed in the first half 65 of the gear box 50. First and second travel limiters 98, 100 can be connected to the rack gear 94. In the non-limiting embodiment shown, the travel limiters 98, 100 are threaded, and are threadably engaged with the rack gear 94. Alternatively, travel limiters (not shown) having smooth surfaces may be slidably engaged with the rack gear 94 in an interference fit therewith, and may be manually moved relative to the rack gear 94.

As yet another alternative, travel limiters (not shown) may be provided which are formed with respective detents (not shown). In such an embodiment, the rack gear is formed with a channel having a series of openings for receiving the detents, and the travel limiters can be manipulated to engage their detents with a preselected pair of the openings in the rack gear channel. In any case, it will be appreciated that the position of the travel limiters of the present invention relative to the rack gear 94 may be manually adjusted.

FIG. 2 shows that in one non-limiting embodiment, each travel limiter 98, 100 has a respective abutment surface 102, 104. As shown, the abutment surfaces 102, 104 can contact a switch 106 which is mounted on a base 107. The base 107 is in turn anchored on the second half 66 of the gear box 50. As intended by the present invention, the switch 106 includes electrically conductive first and second spring arms 108, 112 and an electrically conductive center arm 110. As shown, one end of each spring arm 108, 112 is attached to the base 107, and the opposite ends of the spring arms 108, 112 can move relative to the base 107. As also shown, one end of the center arm 110 is attached to the base 107.

When the main reduction gear 82 has rotated sufficiently counterclockwise, the abutment surface 102 of the first travel limiter 98 contacts the first spring arm 108 of the switch 106 to urge the first spring arm 108 against the stationary center arm 110 of the switch 106. On the other hand, when the main reduction gear 82 has rotated clockwise a sufficient amount, the abutment surface 104 of the second travel limiter 100 contacts the second spring arm 112 of the switch 106 to urge the second spring arm 112 against the stationary center arm 110 of the switch 106.

It can be appreciated in reference to FIG. 2 that the switch 106 can be electrically connected to the circuit board 52 (FIG. 1) via an electrical lead 119. Moreover, the first spring arm 108 can be urged against the center arm 110 to complete one branch of the electrical circuit on the circuit board 48. On the other hand, the second spring arm 112 can be urged against the center arm 110 to complete another branch of the electrical circuit on the circuit board 48.

The completion of either one of the electrical circuits discussed above causes the motor 52 to de-energize and consequently stops the rotation of the main reduction gear 82 and, hence, the rotation the tilt rod 12. Stated differently, the travel limiters 98, 100 may be manually adjusted relative to the rack gear 94 as appropriate for limiting the rotation of the tilt rod 12 by the actuator 10.

Referring briefly back to FIG. 2, spacers 120, 122 may be molded onto the halves 62, 64 for structural stability when the halves 62, 64 of the gear box 56 are snapped together.

Figure 4:
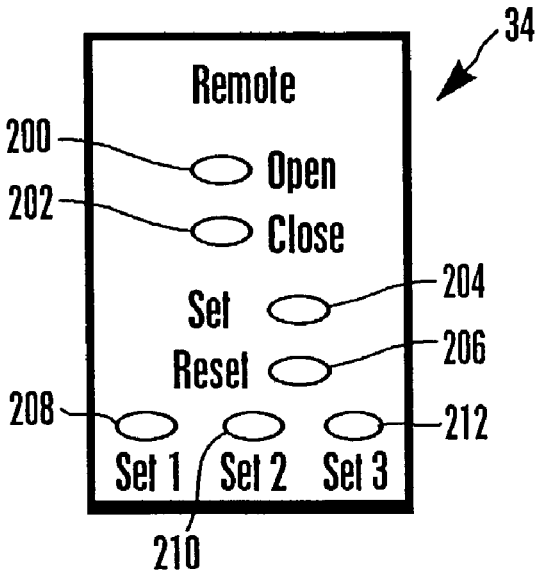
FIG. 4 is a view of a remote control unit.

FIG. 4 shows the presently preferred configuration of the remote control unit 34. As shown, the remote control unit 34 includes several control buttons. More specifically, FIG. 4 shows that the remote 34 includes an "Open" button 200, a "Close" button 202, a "Set" button 204, and if desired, a "Reset" button 206. Moreover, the preferred embodiment of the remote 34 can include a "Set 1" button 208, a "Set 2" button 210, and a "Set 3" button 212. It is to be understood that more set buttons can be included in the construction of the remote, e.g., a "Set 4" button, a "Set 5" button, etc. In accordance with the principles set forth below, the control buttons can be used to operate the actuator 10 and thus, control the blinds 14.

Figure 5:
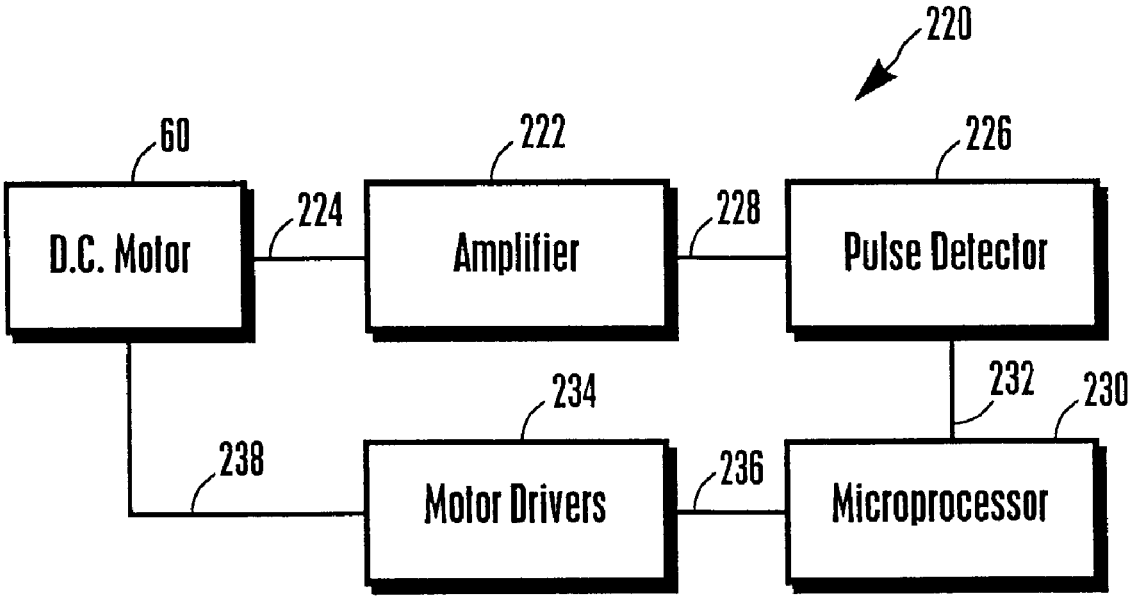
FIG. 5 is a block diagram of the control system.

Referring now to FIG. 5, a block diagram of the control system is shown and generally designated 220. FIG. 5 shows that the control system 220 includes the above-described D.C. motor 60 which is connected to an amplifier 222 via electrical line 224. In turn, the amplifier 222 is connected to a motor current pulse detector 226 via electrical line 228. The motor current pulse detector 226 can be connected to a microprocessor 230 via electrical line 232. FIG. 5 further shows that the microprocessor 230 can be connected to motor drivers 234. As shown, the motor drivers 234 are connected to the motor 60 via electrical line 238. The motor drivers 234 can start and stop the motor 60.

As described in detail below, the motor current pulse detector 226 is used to count the pulses of the current flowing through the motor 60 as it revolves. Since the presently preferred motor 60 includes two poles and three commutator segments, the motor current pulses six times per revolution. Thus, by counting the pulses, the absolute position of the bottom of the blinds 14 can be relatively easily determined. It is to be understood that the amplifier 222, the motor current pulse detector 226, and the microprocessor 232 can be incorporated into the circuit board 48.

Figure 6:
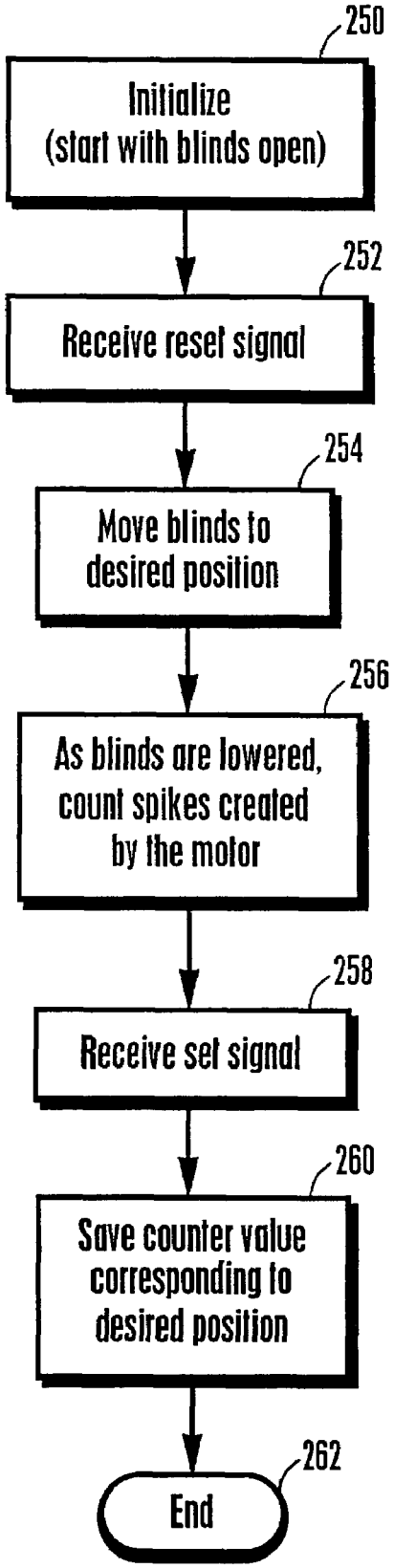
FIG. 6 is a flow chart of the set-up logic of the present invention.

FIG. 6 shows the set-up logic of the present invention. Commencing at block 250, the control system is initialized, i.e., the blinds 14 are opened if they are not already open. This can be accomplished by depressing and holding the "Open" button 200 on the remote control unit 34. At block 252, once the blinds are fully opened, a "Reset" signal, generated when the "Reset" button 206 on the remote control unit 34 is pressed, can be used to set this position as the reference point for controlling the position of the blinds, although it is not necessary to do so. Next, at block 254, the blinds 14 are moved to a desired position, e.g., by pressing the "Close" button 202.

Moving to block 256, as the blinds 14 are lowered to the desired position, the motor current pulse detector 226 counts the electrical spikes or motor current pulses created by the motor 60. Continuing to block 258, a set signal can be received at the actuator, e.g., in response to a user depressing a "Set" button on the remote control unit 34. At block 260, when the set signal is received, the counter value of the motor current pulse detector 226 corresponding to the current position of the blinds 14 is saved at the microprocessor 232. It is to be understood that multiple positions of blinds 14 can be saved and linked to the "Set 1" button 208, the "Set 2" button 210, and the "Set 3" button 212. Further, the more set buttons incorporated into the remote, the more positions of the blinds 14 can be saved. The set-up logic ends at 262.

Figure 7:
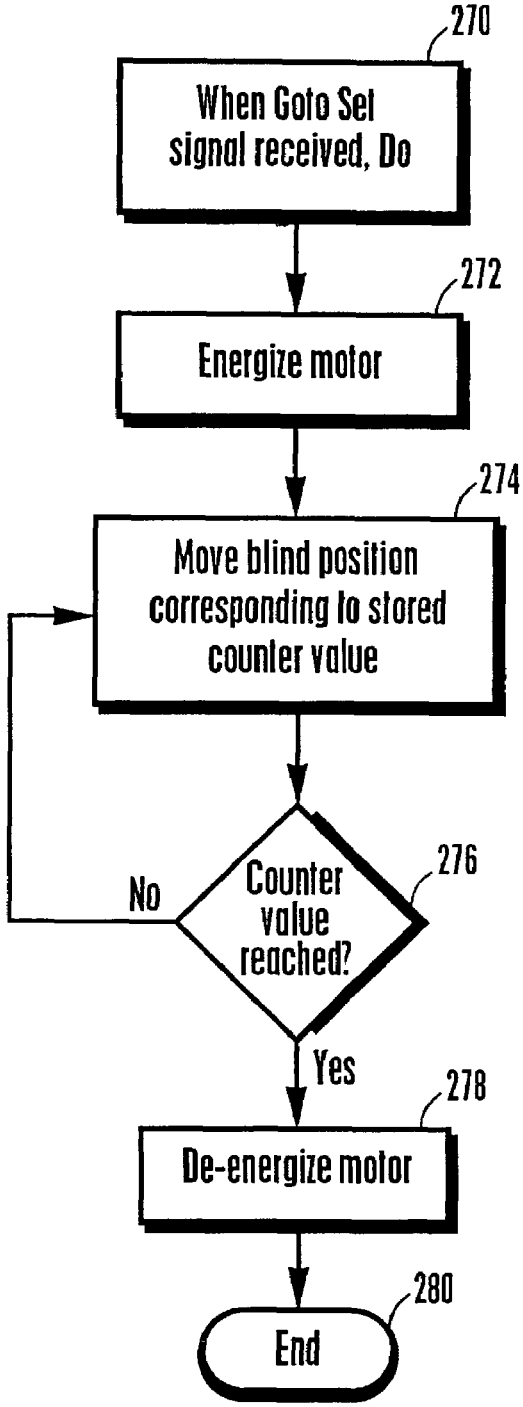
FIG. 7 is a flow chart of the operation logic of the present invention.

Referring now to FIG. 7, the operation logic is shown and commences at block 270 with a do loop wherein when a goto set signal is received, the following steps are performed. Preferably, the goto set signal is generated when either the "Set 1" button 208, the "Set 2" button 210, or the "Set 3" button 212 is pressed on the remote control unit 34. Proceeding to block 272, the motor 60 is energized. At block 272, the blinds 14 are moved to the position corresponding to the stored counter value, i.e., the value that is linked to the particular "Set" button 208, 210, 212 pressed.

Moving to decision diamond 276 it is determined whether the counter value corresponding to the particular "Set" button 208, 210, 212 has been reached. If not, the logic returns to block 274 and the blinds 14 are continued to be moved to the stored counter value. When the counter value is reached, the motor 60 can be de-energized at block 278. The operation logic then ends at 280.

The present invention recognizes that during operation some current pulses of the motor may not be counted. For example, as understood herein, when the motor 60 is moving very slowly, i.e., starting or stopping, the variation in the motor current approaches zero. Under these circumstances, these motor current pulses might not be counted. Occasionally, a motor commutator may bounce and provide two pulses instead of one. If the same number of pulses are lost or gained every time the blinds 14 are moved, there is no adverse consequence to the operation of the blinds 14. However, in terms of lost motor current pulses, moving the blinds 14 up is different from moving the blinds 14 down. Also, stopping under control of the microprocessor 230 may be different from stopping at a hard stop, e.g., the top or bottom of the window frame 22. Since motor current pulses may be added or omitted in some systems, an error correction routine can be invoked for those cases provided there is at least one hard stop. Accordingly, the below-described error correction logic is provided.

Figure 8:
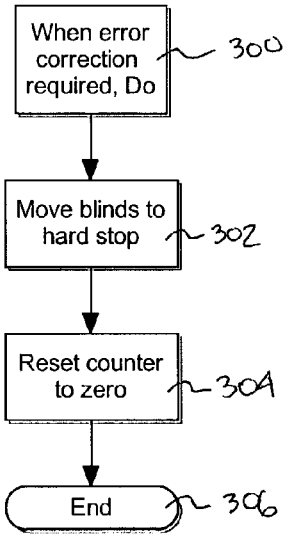
FIG. 8 is a flow chart of the overall error correction logic.

Referring to FIG. 8, the overall error correction logic is shown and commences at block 300 with a do loop wherein when error correction is required the following steps are performed. It can be appreciated that error correction can be required at the initial installation of the blinds 14 and the control system 220. Also, error correction can be performed after a predetermined number of movements of the blinds 14. Or, it can be performed simply on an "as-needed" basis. Moving to block 302, the blinds 14 are moved to a hard stop, e.g., the top or bottom of the window frame 22. Next, at block 304, the position counter is reset to zero. The logic then ends at state 306. By periodically resetting the position counter value to zero, the error in position caused by uncounted motor current pulses does not accumulate indefinitely.

Figure 9:
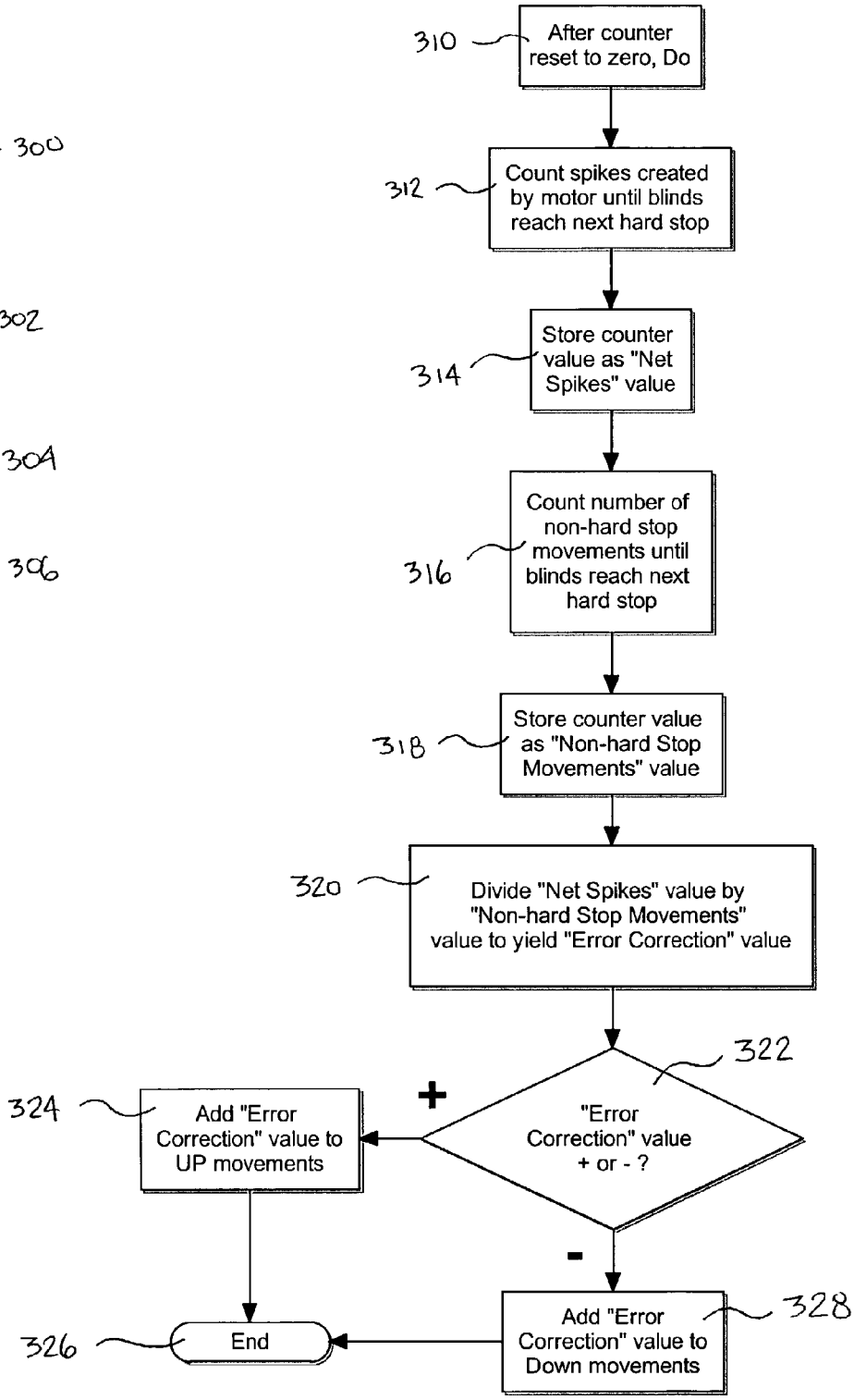
FIG. 9 is a flow chart of error correction logic for consistent up and down blind movement.

If the error correction is consistently in one direction, typically caused by consistent cyclical up and down motion, further error correction can be applied to the control system 220 as shown by the logic in FIG. 9. The error correction logic shown in FIG. 9 commences at block 310 with a do loop, wherein after the counter is reset to zero, the succeeding steps are performed. At block 312, the spikes created by the motor 60 are counted until the blinds 14 reach the next hard stop. Moving to block 314, this counter value is stored as a "Net Spikes" value. Movements in the UP direction are added to the count and movements in the DOWN direction are subtracted from the count.

Returning to the description of the logic, at block 316, the number of non-hard stop movements are also counted until the blinds 14 reach the hard stop. All non-hard stop movements are added to the count. Proceeding to block 318, this counter value is stored as a "Non-hard Stop Movements" value. Next, the logic continues to block 320 where the "Net Spikes" value is divided by the "Non-hard Stop Movements" value to yield an "Error Correction" value.

Moving to decision diamond 322 it is determined whether the "Error Correction" value is positive or negative. If the "Error Correction" value is positive, the logic proceeds to block 324 and the "Error Correction" value is added to the UP movement counts. The logic then ends at state 326. If the "Error Correction" value is negative, the logic flows to block 328 where the "Error Correction" value is added to the DOWN movement counts. The logic then ends at state 326. It can be appreciated that if the correction is not consistently in one direction for some blinds 14 or shades, the error correction logic shown in FIG. 9 is not applicable.

It is to be understood that if the blinds 14 are manipulated manually, i.e., with the motor 52 de-energized, because the motor leads are shorted when the motor is de-energized current flows through the motor, and variations in the current cause pulses that can be counted. In essence, the motor acts like a generator and electromagnetic field (EMF) pulses are generated. The pulses can also be counted by the pulse detector so that the absolute position of the blinds 14 remains known. It is also to be understood that in order to maintain the accuracy of the above described control system 220, periodically, the above-described error correction logic shown in FIGS. 8 and 9 is performed. Thus, any inaccuracies caused by motor current pulses that were not counted by the pulse detector, e.g., at start up, at shut down, or during coast down, are minimized.

While the particular LOW POWER, HIGH RESOLUTION POSITION ENCODER FOR MOTORIZED WINDOW COVERING as herein shown and described in detail is fully capable of attaining the above-described aspects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it is to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. section 112, sixth paragraph, unless the element is expressly recited using the phrase "means for."

We claim:

1. A method for controlling a motorized window covering, comprising the acts of:

providing a counter;

establishing a user-defined position of the window covering;

in response to a user generated signal, energizing a motor coupled to the window covering;

counting pulses of the motor using the counter;

based on the counting act, determining when the window covering reaches the user-defined position;

after a predetermined number of movements moving the window covering to a hard stop;

resetting the counter to zero;

determining an error correction value; and altering a pulse count value based on the error correction value; wherein the error correction value is determined by the acts of:

determining a net spikes value;

determining a non-hard stop movements value; and dividing the net spikes value by the non-hard stop movements value.

2. The method of claim 1, further comprising the act of:

when the window covering reaches the user-defined position, de-energizing the motor.

3. The method of claim 1, wherein the user generated signal is generated by a remote control unit.

4. The method of claim 1, wherein the user-defined position is established by:

energizing the motor to move the window covering;

counting pulses of the motor;

de-energizing the motor to stop the window covering; and saving a pulse count corresponding to the position of the window covering.

5. A motorized window covering, comprising:

a window covering;

an actuator coupled to the window covering, the actuator being used to move the window covering;

a motor coupled to the actuator; and a pulse detector system electrically connected to the motor, the pulse detector system counting pulses of the motor when the motor is energized and periodically being reset to a zero value, the pulse detector system maintaining a count that is altered at least once by the ratio of a number of net motor pulses since a hard stop and a number of non-hard stop movements.

6. The motorized window covering of claim 5, wherein the pulse detector system counts pulses when the window covering is moved while the motor is de-energized.

7. The motorized window covering of claim 6, further comprising:

a microprocessor, the microprocessor being part of the pulse detector system and including a program for moving the window covering.

8. The motorized window covering of claim 7, wherein the program includes:

means for establishing a set position of the window covering;

means for energizing the motor to move the window covering; and means for determining when the window covering reaches a user-defined position.

9. The motorized window covering of claim 8, wherein the program includes:

means for de-energizing the motor when the user-defined position is reached.

10. The motorized window covering of claim 9, wherein the program further includes:

means for saving a pulse count corresponding to the user-defined position of the window covering.

11. The motorized window covering of claim 10, wherein the program further includes:

counting means;

means for periodically moving the window covering to a hard stop; and means for resetting the counting means to zero.

12. The motorized window covering of claim 5, further comprising a head rail supporting the motor and also holding at least one battery electrically connected to the motor.

13. The motorized window covering of claim 12, wherein the at least one battery is an alkaline or Lithium battery.

14. The motorized window covering of claim 13, wherein the at least one battery is the sole source of power for the motor.

* * * * *